343-756 SR
3/13/79 OR 4,144,535

United States Patent [19] [11] 4,144,535
Dragone [45] Mar. 13, 1979

[54] METHOD AND APPARATUS FOR SUBSTANTIALLY REDUCING CROSS POLARIZED RADIATION IN OFFSET REFLECTOR ANTENNAS

[75] Inventor: Corrado Dragone, Little Silver, N.J.

[73] Assignee: Bell Telephone Laboratories, Incorporated, Murray Hill, N.J.

[21] Appl. No.: 770,390

[22] Filed: Feb. 22, 1977

[51] Int. Cl.[2] ..... H01Q 11/10; H01Q 15/24

[52] U.S. Cl. ..... 343/756; 343/909; 343/840

[58] Field of Search ..... 343/781 CA, 781 P, 756, 343/775, 777, 840, 909, 100

[56] References Cited

U.S. PATENT DOCUMENTS

| | | | |
|---|---|---|---|
| 3,148,370 | 9/1964 | Bownan | 343/909 |
| 4,001,836 | 1/1977 | Archer et al. | 343/756 |

*Primary Examiner*—Alfred E. Smith
*Assistant Examiner*—David K. Moore
*Attorney, Agent, or Firm*—Erwin W. Pfeifle

[57] ABSTRACT

The present invention relates to polarization grids for use in offset antenna arrangements, each of the grids comprising a plurality of nonparallel spaced-apart elements which are mounted between an offset curved focusing main reflector and an associated feedhorn in order to obtain linear polarization everywhere in the far field of the reflector. Exemplary types of grids in accordance with the present invention are (1) a family of hyperbolae on an arbitrary plane S, (2) projections of these hyperbolae on an arbitrary surface, and (3) a set of straight lines through a certain point $F_o'$ on plane S which set approximates the hyperbolae of type (1) by means of a tangent to each of the hyperbolae.

12 Claims, 7 Drawing Figures

METHOD AND APPARATUS FOR SUBSTANTIALLY REDUCING CROSS POLARIZED RADIATION IN OFFSET REFLECTOR ANTENNAS

BACKGROUND OF THE INVENTION

1. Field of the Invention

The present invention relates to method and apparatus for substantially reducing cross-polarized radiation in offset reflector antennas and, more particularly, to method and apparatus for substantially reducing cross-polarized radiation in offset reflector antennas by disposing a polarization grid comprising a plurality of nonparallel spaced-apart elements derived from a family of hyperbolae between a main curved focusing reflector and an associated feedhorn.

2. Description of the Prior Art

Cross-polarized radiation from an offset reflector is often regarded as a blemish on an otherwise excellent antenna which offers both low sidelobe level and good impedance matching. Although the cross polarization can be minimized using a large effective F/D ratio, the corresponding requirements of small offset angle and large feed aperture are not always convenient in applications.

Various techniques have been devised to reduce cross-polarized radiation in a transmitted or received beam, where the cross-polarized radiation is introduced by various elements encountered by the beam. For example, U.S. Pat. No. 3,914,764 issued to E. A. Ohm on Oct. 21, 1975 relates to apparatus for reducing cross coupling between orthogonal polarizations in satellite communication systems. In transmission, the linearly polarized transmitted waves experience changes in their polarizations due to polarization rotation and polarization conversion effects of the transmission channel especially in the ionosphere. The patented arrangement used microwave components having fixed characteristics which transform the two varying elliptically polarized waves into replicas of the rotated transmitted waves and then a conventional polarization rotator to align the waves in the originally transmitted directions.

An article "Depolarization Properties of Offset Reflector Antennas" by T. Chu et al in *IEEE Transactions on Antennas and Propagation,* Vol. AP-21, May 1973 at pp. 339–345 discloses and develops the relationships regarding cross-polarization components which are introduced by an offset curved focusing main reflector.

An article "A Dual-Polarized Cylindrical-Reflector Antenna for Communication Satellites" by E. J. Wilkinson in *Microwave Journal,* Vol. 16, December 1973 at pp. 27–30 and 62 discloses an antenna arrangement with low cross polarization. The Wilkinson arrangement includes two orthogonally-polarized feedhorns and a flat polarized ground plane. Rays from the vertically-polarized line source located above the ground plane appear to come from the cylindrical reflector's actual focal line located below the ground plane. The horizontally-polarized line source is placed on the focal line itself and radiates through the polarized ground plane unaffectedly. The article, however, states that the grating did not change the cross-polarization levels for the vertically-polarized source and it deteriorated the cross-polarization levels for the horizontally-polarized source.

An article "Quasi-Optical Polarization Diplexing of Microwaves" by T. Chu et al in *The Bell System Technical Journal,* Vol. 54, December 1975 at pp. 1665–1680 relates to avoiding cross polarization in the feed pattern that illuminates antennas. The quasi-optical diplexer cleans up the two orthogonal polarizations simultaneously just before illuminating the subreflector of an antenna having a main reflector and a subreflector.

SUMMARY OF THE INVENTION

The present invention relates to method and apparatus for substantially reducing cross-polarized radiation in offset reflector antennas and, more particularly, to method and apparatus for substantially reducing cross-polarized radiation in offset reflector antennas by disposing a polarization grid comprising a plurality of nonparallel spaced-apart elements derived from a family of hyperbolae between a main curved focusing reflector and an associated feedhorn.

It is an aspect of the present invention to employ polarization grids to substantially reduce cross-polarized radiation everywhere in the far field of an offset curved main focusing reflector, the grids being formed of a plurality of nonparallel spaced-apart elements which can be formed in accordance with either one of (1) a family of hyperbolae on an arbitrary plane S, (2) projections of these hyperbolae on an arbitrary surface, and (3) a set of straight lines through a certain point $F_o'$ on plane S which set approximates the hyperbolae of type (1) by means of a tangent to each of the hyperbolae.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

Figure 1:
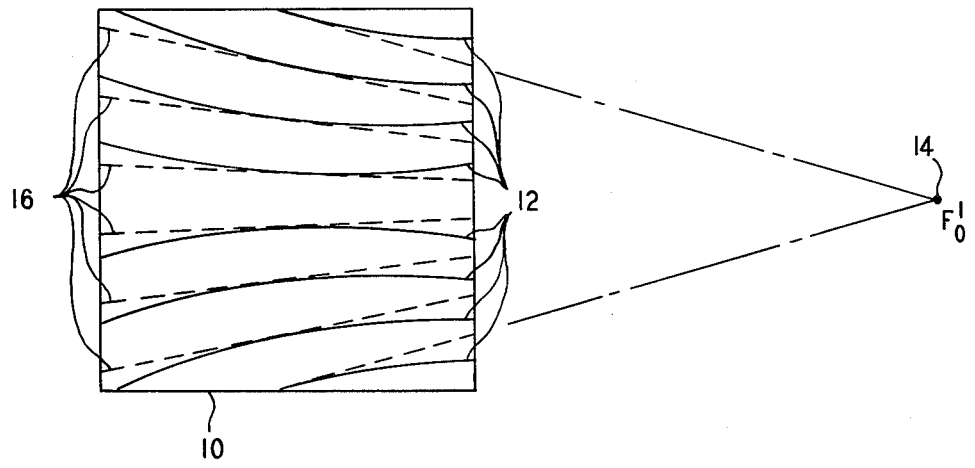
FIG. 1 illustrates two types of polarization grids formed in accordance with the present invention.

In order to increase the communication capacity or a transmission system by using orthogonal polarizations, it becomes essential to maintain the orthogonality to prevent crosstalk. Although cross polarization can be minimized by using a large effective F/D ratio, the corresponding requirements of a small offset angle and a large feed aperture are not always convenient in applications. In accordance with the present invention, polarization grids comprising nonparallel spaced-apart elements derived from a family of hyperbolae are disposed between the offset curved main focusing reflectors and their associated feedhorns to substantially reduce cross-polarized radiation everywhere in the far field of the reflectors.

The polarization properties of the far field of a paraboloid reflector illuminated from its focus by a linearly polarized feed has been discussed by T. Chu et al in the article "Depolarization Properties of Offset Reflector Antennas" in *IEEE Transactions on Antennas and Propagation,* Vol. AP-21, May 1973 at pp. 334–345. The feed considered in the Chu et al article is perfect in the sense that it will result in a linearly polarized far field of the paraboloid reflector, provided the feed axis is oriented parallel to the axis of the paraboloid reflector. To prevent aperture blockage, the feed axis for the offset paraboloid reflector is tilted by a nonzero angle and, as a consequence, the Chu et al article shows that the far field will contain, in addition to the desired polarization, a cross-polarized component. This cross-polarized component can be substantially eliminated by using a polarization grid 10 formed in accordance with the present invention and shown in FIG. 1, which polarization grid can comprise any one of the following three types: (1) a family of hyperbolae, shown typically by the solid lines 12 in FIG. 1, on an arbitrary plane, (2) projections of the family of hyperbolae of type (1) on an arbitrary surface such as, for example, a curved surface, and (3) a set of straight lines, shown as dashed lines 16 in FIG. 1, through a single point $F_o'$, designated 14 in FIG. 1, which set approximates the hyperbolae of type (1) by means of a tangent to each of the hyperbolae. These grids are useful for polarization diplexing and will be discussed hereinafter in the sequence presented above.

The present invention is described hereinafter in conjunction with a paraboloid reflector. It is to be understood that the term paraboloid is exemplary only and is for the purposes of exposition and not for purposes of limitation. It will be readily appreciated that the inventive concept described is equally applicable to reflectors associated with either Cassegrainian or Gregorian antenna systems where the reflector can consist of a paraboloid or a combination of a paraboloid and either a confocal ellipsoid or hyperboloid which, as is well known to those skilled in the art, can be shown to be the equivalent of a paraboloid.

Figure 2:
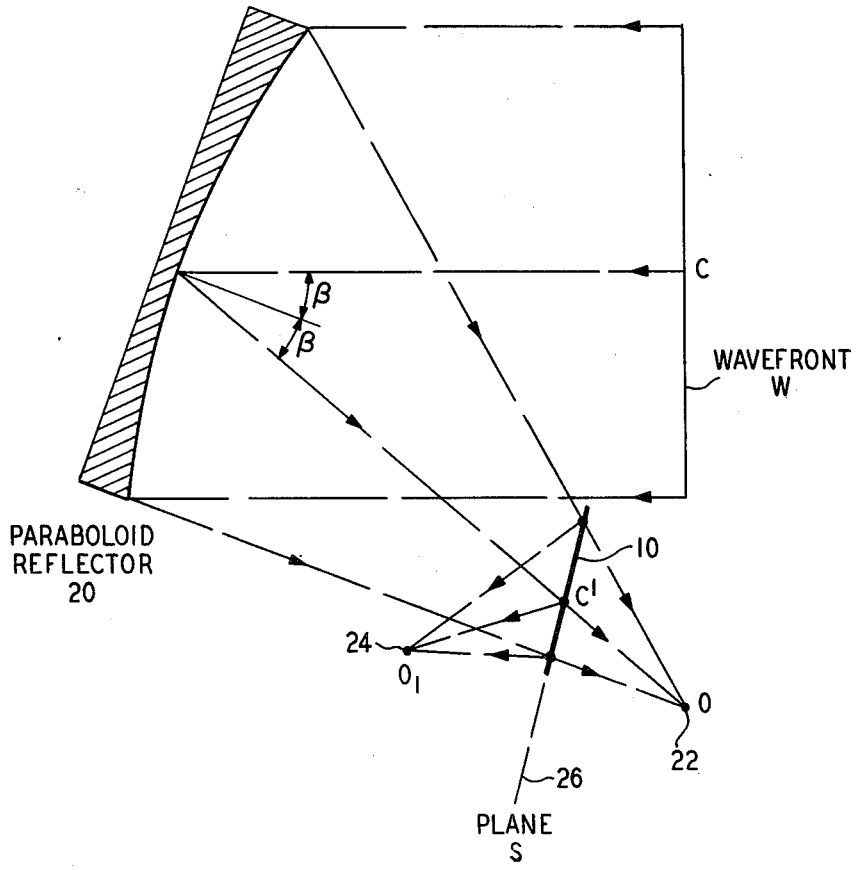
FIG. 2 illustrates the geometry of an offset paraboloid reflector antenna modified to include a polarization grid in accordance with the present invention.

FIG. 2 illustrates an offset paraboloid reflector 20 arranged to reflect a plane wave W consisting of two linearly polarized components of orthogonal polarizations, to be hereinafter referred to as $\vec{e}$ and $\vec{e}'$ which are unit vectors in the directions $\vec{E}$ and $\vec{E}'$, respectively, towards a polarization grid 10 of, for example, the first type mentioned hereinbefore in accordance with the present invention. Then, if a plane wave polarized in the direction of $\vec{e}'$ is incident on paraboloid reflector 20, the resulting spherical wave reflected by reflector 20 will pass through grid 10, without reflection, and will, therefore, converge towards a first focus 0, designated 22. If, however, the polarization of the plane wave is rotated by 90 degrees, so that it is now given by a unit vector $\vec{e}$, orthogonal to $\vec{e}'$, the spherical wave reflected by reflector 20 will be totally reflected by grid 10, and will, therefore, converge towards second focus $0_1$, designated 24. Thus, if an arbitrary plane wave is incident on paraboloid reflector 20, the spherical wave incident on grid 10 will be resolved, by the grid, into two components corresponding respectively to the two polarization vectors $\vec{e}'$ and $\vec{e}$. The two components may then be received by two separate feeds placed at focal points 22 and 24 thus obtaining perfect diplexing of the two orthogonal polarizations $\vec{e}'$ and $\vec{e}$, respectively.

If in FIG. 2 the plane S, designated 26 and on which grid 10 is placed, is replaced by a hyperboloid with its foci at focal points 22 and 24, respectively, the grid then becomes the type (2) grid mentioned hereinbefore. Such grid has the advantage that the two equivalent focal lengths corresponding to the foci 22 and 24 may now be different. A simple fabrication technique for the grid of type (2) will be described hereinafter.

A procedure for determining the curves along which the grid elements are to be placed will now be described. This procedure is applicable, not only to the type (1) grids, where a plane wave W is transformed by a paraboloid reflector 20 into a spherical wave incident on grid 10, but also to the general case where both the incident wave W and the reflector 20 are arbitrary. By this procedure it is possible to determine both where an arbitrary grid is to be mounted on plane 26, in FIG. 2, with a point source placed at first focal point 22, and the polarization of the resulting plane wave reflected by the paraboloid. It will be assumed throughout the discussion of the exemplary procedure that the laws of geometric optics are satisfied, and that the grids consist of thin, closely spaced, perfectly conducting wires.

For purposes of clarity, the grids in accordance with the present invention are considered to have the following properties. On a wavefront reflected by a grid, the lines of $\vec{E}$, which are the set of lines everywhere tangent to $\vec{E}$, are the projections of the grid wires. Thus, a particular $\vec{E}$-line is the curve on the wavefront as determined by the ray reflected by the corresponding grid wire. On a transmitted wavefront, on the other hand, the projections of the grid wires give the $\vec{H}$-lines associated with radiation from focal point 22. It can also be shown that a wavefront will be totally reflected by a grid if its $\vec{E}$-lines are the projections of the grid wires. The $\vec{E}'$-lines, however, being orthogonal to the wire projections will result in the wavefront passing through the grid without reflection.

Therefore, for a reflecting surface, if W is a linearly polarized wavefront incident on an arbitrary reflecting surface 20 and W' is the wavefront reflected therefrom, the $\vec{E}$-lines of W' are simply the projections of the $\vec{E}$-lines of wavefront W. Such statement provides a simple method for determining the polarization of a wave reflected by reflector 20 when the polarization of the incident wave is given since only a projection is required. It follows that if the grid wires are placed along projections of the $\vec{E}$-lines of W, then the wave incident on grid 10 will be totally reflected and, as shown in FIG. 2, converge towards second focal point 24. If, instead, the grid wires are placed along the projections of the $\vec{H}$-lines of wavefront W, the wave will pass through grid 10 without any reflection and converge towards first focal point 22.

Figure 3:
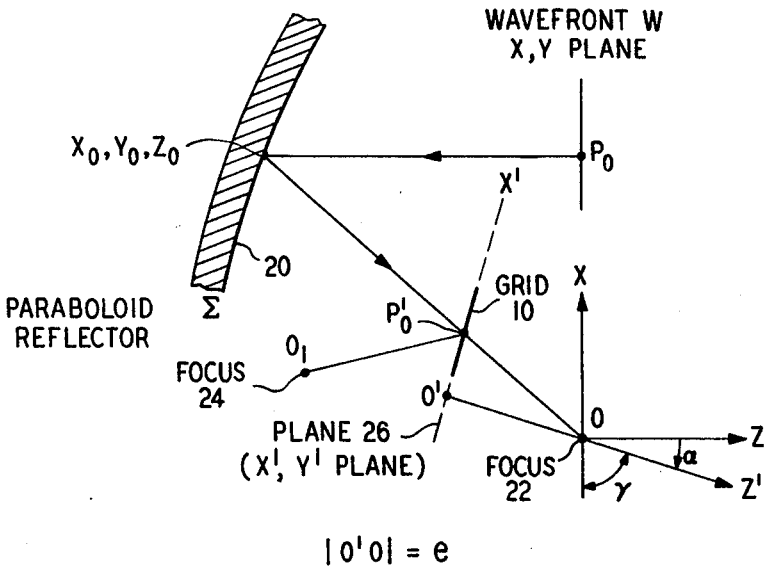
FIG. 3 illustrates an exemplary ray in the wavefront projected through the geometry of FIG. 2.

More particularly, to determine the configuration of the grids in accordance with the present invention, a linearly polarized wave with $\vec{E}$ in the direction of the unit vector given by $$\vec{e}=\vec{i}_x \cos \alpha+\vec{i}_y \sin \alpha, \quad (1)$$

where $\alpha$ is the angle between the x axis and the z' vector in FIG. 3, will be considered transformed by reflector 20 into a spherical wave converging towards first focus 22. On plane 26 a set of wires forming rigid 10 is placed so as to obtain total reflection of the spherical wave.

As shown in FIG. 3, the coordinate system x, y, z is centered at first focus 22, also designated 0, with the z-axis along the axis of reflector 20 and the xz-plane orthogonal to the plane 26 of grid 10. Additionally, the x', y', 2'-system is shown with the x', y'-plane in the plane 26 of grid 10 and the z'-axis passing through first focus 22. The equation of paraboloid reflector 20 is $$z=(x^2+y^2/4f)-f \tag{2}$$

where f is the focal length, and, in FIG. 3, W is the incident wavefront given by the plane z =0. To determine the location of a wire on plane 26, the projection $P_o'$ on plane 26 of a point $P_o$ of wavefront W is first obtained. From FIG. 3, if $x_o$, $y_o$ are the coordinates of point $P_o$, then the point $P_o'$ is given by the intersection with plane 26 of the ray which has the coordinates $x_o$, $y_o$, $z_o$ on reflector 20, where $$Z_o=(x_o^2+y_o^2/4f)-f. \tag{3}$$

The equation of this ray in the x, y, z-system is $$x/x_o=y/y_o=z/z_o \tag{4}$$

and, in the x', y', z'-system, $$\frac{-(z'-l)\sin\alpha+x'\cos\alpha}{x_o}=\frac{y'}{y_o}=\frac{(z'-l)\cos\alpha+x'\sin\alpha}{z_o}, \tag{5}$$

where $l = |00'|$ is the distance of grid 10 from first focus 22 and α is the angle shown in FIG. 3 between the normal to grid 10 and the axis of paraboloid reflector 20. The coordinates $x_o'$, $y_o'$, of $P_o'$ are obtained by setting z' = 0 in Equation (5) and then solving for $x' = x_o'$ and $y' = y_o'$. Taking into account Equation (3) one obtains $$\left.\begin{aligned}\frac{x_o'}{l}&=\frac{\sin\alpha(x_o^2+y_o^2-4f^2)+\cos\alpha\,4fx_o}{\cos\alpha(x_o^2+y_o^2-4f^2)-\sin\alpha\,4fx_o}\\ \frac{y_o'}{l}&=\frac{4fy_o}{\cos\alpha(x_o^2+y_o^2-4f^2)-\sin\alpha\,4fx}\end{aligned}\right\} \tag{6}$$

To obtain the location of a wire on plane 26, the curve described by $P_o'$ is next determined as $P_o$ moves along one of the $\vec{E}$-lines of wavefront W which is written in parametric form as $$x_o=\xi\cos\gamma-\eta\sin\gamma \tag{7}$$

$$y_o=\xi\sin\gamma+\eta\cos\gamma. \tag{8}$$

As parameter ξ is varied, with η held constant, $P_o$ moves along a line which is titled at angle γ with respect to the x-axis and is located at a distance η from the origin. Substituting Equations (7) and (8) in Equation (6) one obtains for the x', y'-coordinates of $P_o'$ $$\left.\begin{aligned}\frac{x_o'}{l}&=-\frac{N}{D}\\ \frac{y_o'}{l}&=-\frac{4f(\xi\sin\gamma+\eta\cos\gamma)}{D}\end{aligned}\right\} \tag{9}$$

where $$N=(\xi^2+\eta^2-4f^2)\sin\alpha+(\xi\cos\gamma-\eta\sin\gamma)4f\cos\alpha \tag{10}$$

$$D=(\xi^2+\eta^2-4f^2)\cos\alpha-(\xi\cos\gamma-\eta\sin\gamma)4f\sin\alpha \tag{11}$$

By eliminating the parameter ξ from Equations (9-11), the curve $$n = \text{const.}$$

can be seen as a hyperbola.

A grid 10 of type (1) in accordance with the present invention, having its wires or elements disposed along a set of hyperbolae as given by Equations (9-11) for different η will cause the incident spherical wave to be totally reflected towards the second focal point 24 which has the coordinates $$x' = -y = 0, z' = -l. \tag{12}$$

If, however, the polarization of a plane wave incident on paraboloid reflector 20 is rotated by 90 degrees, the spherical wave will not be affected by the wires of grid 10. By reciprocity, a point source positioned at first focal point 22 will produce, after transmission through plane 26 and reflection by reflector 20, a plane wave w polarized orthogonal to $\vec{e}$. A point source positioned at second focal point 24, however, will cause the polarization of plane wave W to be in the direction of $\vec{e}$.

Figure 4:
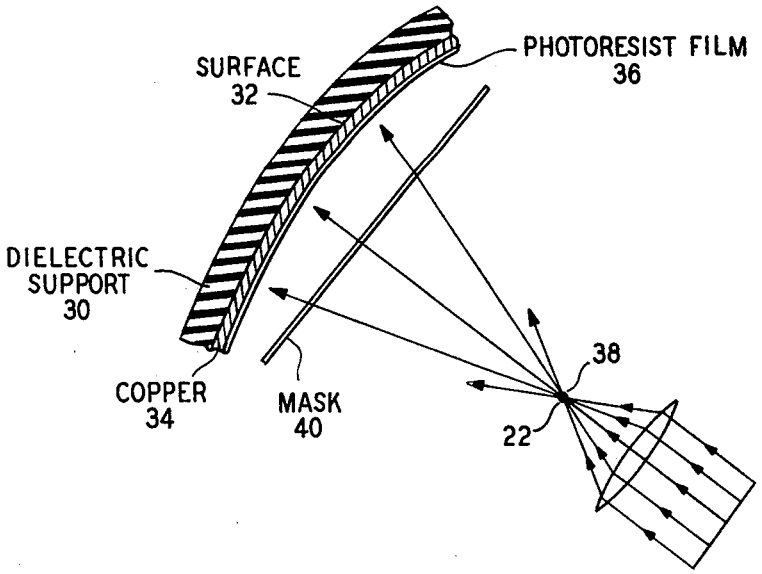
FIG. 4 illustrates a means for fabricating a grid on a curved surface in accordance with the present invention.

FIG. 4 illustrates an exemplary method for fabricating a polarization grid on a curved surface to produce a type (2) grid in accordance with the present invention. In FIG. 4 a dielectric support 30 is shown with one of its surface 32 coated with a thin copper layer 34. Copper layer 34 is covered by a photo-resist film 36 which is exposed to light from a point source 38 emanating from first focal point 22. A mask 40, having areas comprising a set of very narrow opaque strips disposed along the set of hyperbolae derived hereinbefore, is positioned on a flat surface on a plane 26 of FIGS. 2 and 3 between photo-resist film 36 and light source 38.

After exposure, the photo-resist film 36 and the copper layer 34 are removed from the exposed areas of surface 32. As a result, surface 32 will be covered by a set of thin copper strips 42, as shown in FIG. 5, which are projections of the hyperbolae of mask 40 and, therefore, are also the projections of the $\vec{E}$-lines of the wavefront W of FIGS. 2 and 3.

Figure 5:
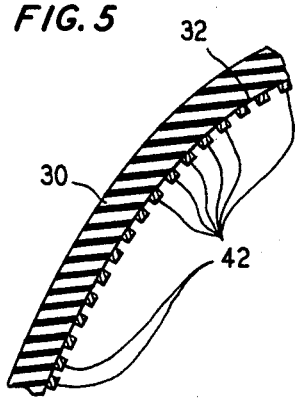
FIG. 5 illustrates a cross section of a polarization grid fabricated by the means of FIG. 4.

The end result, shown in FIG. 5, is a set of wires 42 supported by dielectric support 30 with the dielectric support 30 being disposed on the side of surface 32 facing paraboloid reflector 20. To obtain a grid 10 with a dielectric support on the other side of surface 32 of FIG. 4, dielectric support 30 in FIG. 4 can be replaced with a layer of aluminum, or other material which will be removed at a later point. Then, after etching the copper from the exposed areas, a dielectric support is formed on the side of layer 34 which faces first focal point 22 and the aluminum layer removed with a suitable solvent. It is to be noted that the mask 40 is independent of the shape of surface 32 and, therefore, the same mask can be used for different shaped surfaces.

A disadvantage of the grids of type (1) and (2) described thus far is that, because the elements are curved, they require, in general, a dielectric support. Plane grids consisting of straight wires, instead, have the advantage that the wires can be supported by simply stretching them between their end points.

As shown in FIG. 1, a grid of type (3), according to the present invention, has the hyperbolic shaped elements disposed in accordance with Equations (9-11) replaced by a set of straight elements 16 which meet at an arbitrary point 14, designated $F_o'$, in plane 26. For an understanding of this type of grid the projections of the straight elements on wavefront W will be determined to obtain the lines of $\vec{E}$ when a point source is positioned at second focal point 24 in FIGS. 2 and 3. Since the elements are no longer hyperbolae, the direction of $\vec{E}$ in general will differ from $\vec{e}$, and it becomes necessary to determine the angle $\theta_\xi$ between $\vec{E}$ and $\vec{e}$ and find the optimum choice of point 14 which minimizes $\theta_\xi$ in the vicinity of a particular point C of wavefront W.

To determine the projection of any straight grid element or wire on wavefront W, the reflector 20 is first cut with a plane passing through first focus 22 and containing the particular grid element. The resulting ellipse on reflector 20 is then projected on wavefront W. It can be mathematically shown that if a paraboloid is cut by an arbitrary plane, the projection of the resulting ellipse on wavefront W is always a circle. It, therefore, follows that the projections of the straight grid wires or elements on wavefront W are circles. It is to be understood that a grid point theoretically gives rise to two projections on wavefront W since a straight line passing through both first focal point 22 and the particular grid point always intercepts an extended paraboloid at two distinct points. Thus, together with the fact that all of the grid wires pass through point $F_o'$, designated 14 in FIG. 1, shows that the projections of the grid wires on wavefront W are a set of circles through the two points $F_o$ and $\overline{F}_o$ which correspond to projections of $F_o'$. The two points $F_o$ and $\overline{F}_o$ can be shown to be on a line through first focal point 22, also designated 0, and that their distances from first focal point 22 satisfy the relationship $$|F_oO|\ |\overline{F}_oO| = 4f^2 \tag{13}$$

which allows $\overline{F}_o$ to be determined once $F_o$ is given. Thus, once $F_o$ is chosen, all $\vec{E}$-lines on wavefront W are uniquely determined.

It can be seen that there are infinite number of grid positions that will result in the same $F_o$ on wavefront W. In fact, to produce a given $F_o$ the only requirement that a grid must satisfy is that the point $F_o'$ be placed on the ray from first focal point 22 to $F_o$. An important result is that a rotation of a grid 10 around $F_o'$, the point 14 in FIG. 1, or a translation in the direction of $OF_o'$ will have no effect on the $\vec{E}$-lines on wavefront W. In the particular case where $F_o'$ is at $\infty$, where the grid consists of parallel wires, any translation, or rotation around one of the wires, will have no effect on the $\vec{E}$-lines on wavefront W.

When a point source 38 is placed at foci 22 or 24, only the area on wavefront W that corresponds to the projected aperture of paraboloid reflector 20 is illuminated by the reflected rays. Thus, only the polarization of this area is of importance. For a small projected aperture 40 centered around a point C of wavefront W, the optimum $F_o$ that minimizes $\theta_\xi$, giving the deviation of $\vec{E}$ from the desired polarization $\vec{e}$, was found to be the point shown in FIG. 6. This point is determined by the following two conditions: (1) $OF_o$ is parallel to the desired polarization, $\vec{e}$, and (2) the segment $F_o\overline{F}_o$ is bisected by the projection $C_\xi$ of C.

Figure 6:
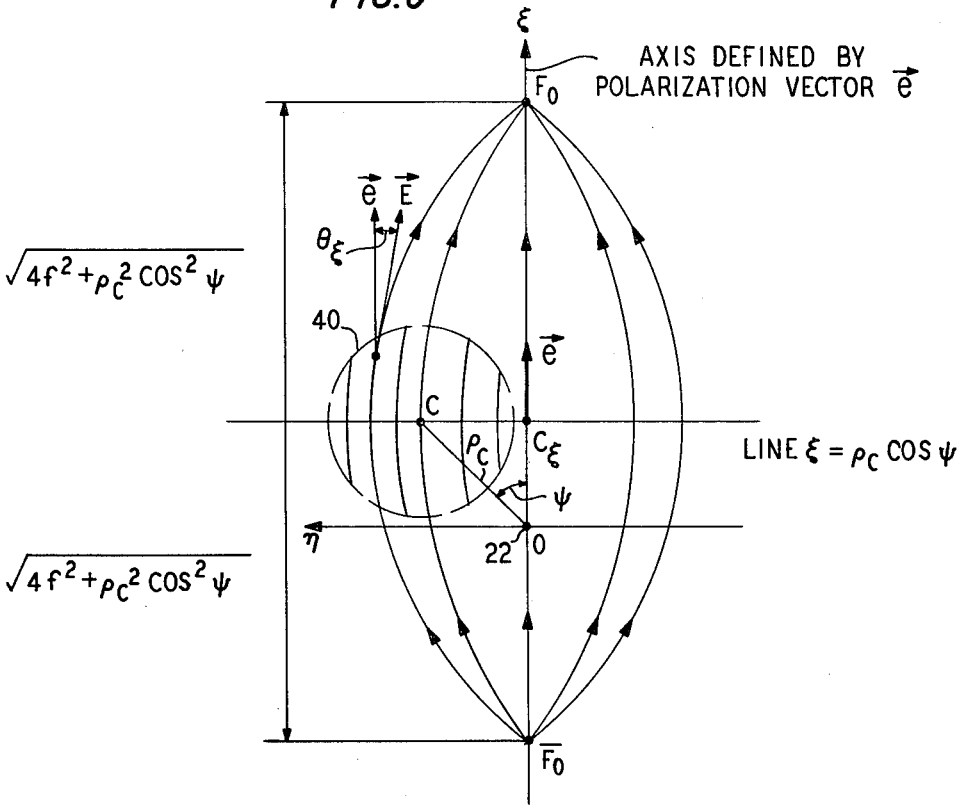
FIG. 6 illustrates the $\vec{E}$-lines on a wavefront of the offset reflector of FIG. 2 when a polarization grid, in accordance with the present invention, consists of straight nonparallel elements through a point $F_o'$.

Thus, in a coordinate system $\xi$ where $\eta$ is centered at 0, focal point 22, with the $\xi$-axis parallel to the desired polarization $\vec{e}$, then from FIG. 6, taking into account the above two conditions and Equation (13), it can be determined that both $F_o$ and $\overline{F}_o$ lie on the $\xi$-axis and their coordinates are $$\xi = \rho_c \cos\psi \pm \sqrt{4f'^2 + \rho_c{}^2\cos^2\psi}, \tag{14}$$

where $\rho_c$, the distance of C from the axis of paraboloid reflector 20, is given by $$\rho_c = 2f \tan\beta, \tag{15}$$

$\beta$ being the angle of incidence, shown in FIG. 2. The angle $\psi$ between $\vec{e}$ and OC, shown in FIG. 6, gives the inclination of the desired polarization $\vec{e}$ with respect to the plane of incidence corresponding to C. As will be shown hereinafter, the best choice of $\psi$ is $\psi = 0$, in which case $\vec{e}$ lies in the plane of incidence.

Figure 7:
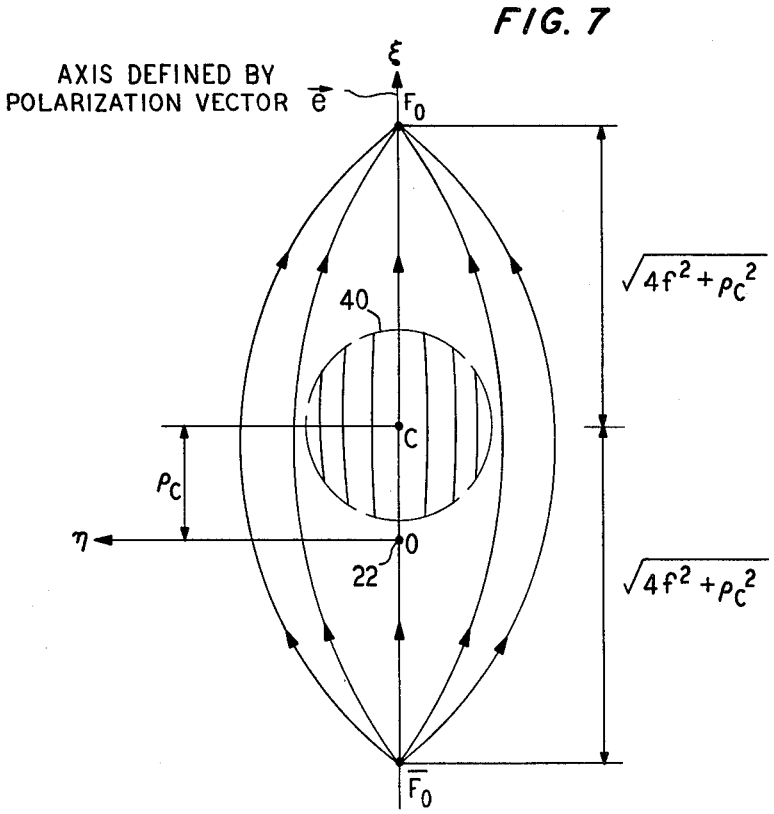
FIG. 7 illustrates the $\vec{E}$-lines on the wavefront of the offset reflector of FIG. 2 with the central point C positioned on the $\xi$-axis.

The angle $\theta_\xi$ between $\vec{E}$ and $\vec{e}$ in FIG. 6 can be determined from the equation $$\tan\theta_\xi = -\frac{2(\xi - \rho_c\cos\psi)\eta}{(\xi - \rho_c\cos\psi)^2 - \eta^2 - 4f'^2 - \rho_c^2\cos^2\psi}, \tag{16}$$

which in the vicinity of point c gives $$\theta_\xi \approx -1/R_c(\xi - \rho_c\cos\psi), \tag{17}$$

where $$R_c = \tfrac{1}{2}(\rho_c{}^2 + 4f'^2/\rho_c \sin\psi) \tag{18}$$

and is the radius of the $\vec{E}$-line through C. Since $R_c \rightarrow \infty$ for $\psi \rightarrow 0$, the choice of $\psi$ that minimizes $|\theta_{86}|$ in the vicinity of C is $\psi = 0$ in which case the $\vec{E}$-lines assume the form illustrated in FIG. 7.

The projection of $F_o$ on the grid plane gives the point $F_o'$ through which the grid wires 16 are to be placed. The X', y'-coordinates of $F_o'$ are $$\frac{x_o'}{l} = -\frac{\rho_c\cos\psi\sin\alpha + 2f\cos\alpha\cos\gamma}{\rho_c\cos\psi\cos\alpha - 2f\sin\alpha\cos\gamma} \tag{19}$$

$$\frac{y_o'}{l} = -\frac{2f\sin\gamma}{\rho_c\cos\psi\cos\alpha - 2f\sin\alpha\cos\gamma}, \tag{20}$$

as can be seen by substituting Equation (14) in Equations (9–11) with $\eta = 0$.

Thus, where the grid consists of a set of straight wires on a plane 26, the reflected $\vec{E}$ will contain, in addition to the desired component in the direction of $\vec{e}$, a small component orthogonal to $\vec{e}$. The amplitude of this cross-polarized component depends on the particular location on the grid plane 26 of the point $F_o'$ that defines the grid wires. The optimum choice of $F_o'$ which minimizes the cross-polarized component has been determined hereinbefore. For this optimum $F_o'$, the cross-polarized component is found to be independent of the choice of the grid plane. It depends only on the angle of incidence $\beta$ on paraboloid 20 and the orientation of $\vec{e}$, with respect to the plane of incidence. For certain orientations of plane 26, the optimum location of $F_o'$ is at infinity, in which case the grid consists of parallel wires.

Advantageously, in accordance with the present invention, grids 10, formed in any one of the configurations according to the present invention, can be positioned at any angle to the feed axis of reflector 20 to provide substantial cross-polarization cancellation.

It is to be understood that the above-described embodiments are simply illustrative of the principles of the invention. Various other modifications and changes may be made by those skilled in the art which will embody the principles of the invention and fall within the spirit and scope thereof.

What is claimed is:

1. A method of compensating for cross-polarization components introduced in a beam of polarized electromagnetic waves when the beam is reflected from the curved surface of a focusing offset main reflector, the method comprising the steps of:

(a) passing electromagnetic waves of the beam, which are both polarized in a first direction and propagating in either direction between the main reflector and a first focal point of said beam, through a polarizing grid comprising a plurality of nonparallel spaced-apart elements which are disposed along paths derived from a set of hyperbolae for introducing cross-polarization components which substantially cancel the cross-polarization components introduced by the main reflector; and (b) reflecting electromagnetic waves of the beam, which are polarized in a second direction orthogonal to said first direction and propagating in either direction between the main reflector and a second focal point, from the polarizing grid for introducing cross-polarization components which substantially cancel the cross-polarization components introduced by the main reflector.

2. The method according to claim 1 wherein in step (a) the electromagnetic waves of the beam are passing through the grid wherein said plurality of nonparallel elements are disposed to form a set of hyperbolae on a flat plane which hyperbolae correspond to projections on said flat plane of the $\vec{E}$-lines of said second direction of polarization normally found in a waveform in the aperture of said main reflector.

3. The method according to claim 1 wherein in step (a) the electromagnetic waves of the beam are passing through the grid wherein said plurality of nonparallel spaced-apart elements are disposed on an arbitrary nonflat dielectric carrier in accordance with said derivative of the set of hyperbolae which corresponds to projections on said nonflat dielectric carrier of the $\vec{E}$-lines of said second direction of polarization normally found in a wavefront in the aperture of said main reflector.

4. The method according to claim 1 wherein in step (a) the electromagnetic waves of the beam are passing through the grid wherein said plurality of nonparallel spaced-apart elements are disposed on a flat plane as tangents to said set of hyperbolae which hyperbolae correspond to projections on said flat plane of the $\vec{E}$-lines of said second direction of polarization normally found in a wavefront in the aperture of said main reflector, said tangents converging through a prescribed point on said flat plane.

5. A polarization grid for disposition between an offset curved main focusing reflector and a first focal point thereof said grid being capable of passing therethrough electromagnetic radiation polarized in a first orthogonal direction between the main reflector and the first focal point and reflecting electromagnetic radiation polarized in a second orthogonal direction between the main reflector and a second focal point while concurrently introducing cross-polarization components which substantially cancel the cross-polarization components introduced by the offset main reflector, the grid comprising a plurality of nonparallel spaced-apart elements disposed along paths derived from a set of hyperbolae, and means capable of structurally maintaining said elements along said paths derived from the set of hyperbolae.

6. A polarization grid according to claim 5 wherein said plurality of nonparallel spaced-apart grid elements are disposed to form a set of hyperbolae on a flat plane.

7. A polarization grid according to claim 5 wherein said plurality of nonparallel spaced-apart grid elements are disposed on an arbitrary nonflat dielectric carrier along said paths derived from the set of hyperbolae.

8. A polarization grid according to claim 5 wherein said plurality of nonparallel spaced-apart grid elements are disposed on a flat plane as tangents to each of the hyperbolae of the set with said tangents converging through a prescribed point on said flat plane.

9. A cross polarization suppressed offset antenna arrangement comprising:

a curved focusing offset main reflector which inherently introduces cross-polarization components in a beam of polarized electromagnetic radiation when reflecting said beam in either direction between the aperture and a first focal point thereof; and a polarization grid comprising a plurality of nonparallel spaced-apart elements which are disposed along paths derived from a set of hyperbolae, the elements being arranged to pass therethrough the electromagnetic radiation polarized in a first direction and to reflect electromagnetic radiation polarized both in a second direction orthogonal to said first direction and propagating in said beam between the main reflector and a second focal point while concurrently introducing cross-polarization components which substantially cancel the cross-polarization components introduced by the main reflector.

10. A cross polarization suppressed offset antenna arrangement according to claim 9 wherein said plurality of nonparallel spaced-apart grid elements are disposed to form a set of hyperbolae on a flat plane which hyperbolae correspond to projections on said flat plane of the $\vec{E}$-lines of said second direction of polarization normally found in a wavefront in the aperture of said main reflector.

11. A cross polarization suppressed offset antenna arrangement according to claim 9 wherein said plurality of nonparallel spaced-apart grid elements are disposed on an arbitrary nonflat dielectric carrier in accordance with said derivative of the set of hyperbolae which correspond to projections on said arbitrary nonflat dielectric carrier of the $\vec{E}$-lines of said second direction of polarization normally found in a wavefront in the aperture of said main reflector.

12. A cross polarization suppressed offset antenna arrangement according to claim 9 wherein said plurality of nonparallel spaced-apart grid elements are disposed on a flat plane as tangents to said set of hyperbolae which hyperbolae correspond to projections on said flat plane of the $\vec{E}$-lines of said second direction of polarization normally found in a wavefront in the aperture of said main reflector, said tangents converging through a prescribed point on said flat plane.

* * * * *